US009816291B2

(12) United States Patent
Wong et al.

(10) Patent No.: US 9,816,291 B2
(45) Date of Patent: Nov. 14, 2017

(54) EXIT PUSH RAIL MONITORING SYSTEM WITH HALL EFFECT SENSOR

(71) Applicant: Sargent Manufacturing Company, New Haven, CT (US)

(72) Inventors: Wai P. Wong, Orange, CT (US); Arthur F. Limoncelli, Jr., New Haven, CT (US); David C. DeBiase, Wallingford, CT (US); Paul Nunez, Orange, CT (US); Eugene W. Lawrence, III, Kensington, CT (US); John E. Walsh, New Haven, CT (US); Angelo S. Arcaria, Colchester, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 0 days.

(21) Appl. No.: 15/102,452

(22) PCT Filed: Jan. 8, 2015

(86) PCT No.: PCT/US2015/010581

§ 371 (c)(1),
(2) Date: Jun. 7, 2016

(87) PCT Pub. No.: WO2015/105946

PCT Pub. Date: Jul. 16, 2015

(65) Prior Publication Data

US 2016/0319570 A1 Nov. 3, 2016

Related U.S. Application Data

(60) Provisional application No. 61/934,208, filed on Jan. 31, 2014, provisional application No. 61/925,794, filed on Jan. 10, 2014.

(51) Int. Cl.
*G08B 13/08* (2006.01)
*E05B 47/00* (2006.01)
(Continued)

(52) U.S. Cl.
CPC ..... *E05B 47/00* (2013.01); *E05B 43/005* (2013.01); *E05B 45/06* (2013.01);
(Continued)

(58) Field of Classification Search
CPC ..... E05B 65/1046; E05B 65/1053; E05B 65/108; E05B 47/00; E05B 43/005; E05B 45/06; Y10T 70/5159
(Continued)

(56) References Cited

U.S. PATENT DOCUMENTS 4,257,631 A 3/1981 Logan, Jr.
4,287,512 A 9/1981 Combs
(Continued)

*Primary Examiner* — Thomas Mullen
(74) *Attorney, Agent, or Firm* — DeLio, Peterson & Curcio, LLC; David R. Pegnataro

(57) ABSTRACT

A delayed egress exit push rail system for a door has a push rail movable relative to a housing between a home position and a second position to open the door, a sensor for determining the position of the push rail as the push rail moves between the home position and the second position and a controller connected to the sensor. The sensor detects a current position of the push rail in the home position and the controller determines if the current position of the push rail detected by the sensor is within a predetermined acceptable range of positions relative to the home position. If the controller determines that the current position of the push rail is outside of the predetermined range, the controller unlocks the door for immediate egress, relays an error message via light or sound and/or communicates with a remote monitoring device.

20 Claims, 7 Drawing Sheets

(51) Int. Cl.
*E05B 43/00* (2006.01)
*E05B 65/10* (2006.01)
*E05B 45/06* (2006.01)

(52) U.S. Cl.
CPC .. *E05B 65/1053* (2013.01); *E05B 2045/0615* (2013.01); *E05B 2047/0059* (2013.01); *E05B 2047/0067* (2013.01)

(58) Field of Classification Search
USPC ..... 340/545.1, 545.7, 547
See application file for complete search history.

(56) References Cited

U.S. PATENT DOCUMENTS

| | | | | |
|---|---|---|---|---|
| 6,048,000 | A * | 4/2000 | Geringer et al. | E05B 47/0002 292/166 |
| 8,495,836 | B2 | 7/2013 | Lowder et al. | |
| 2005/0104381 | A1 | 5/2005 | Whitaker et al. | |
| 2010/0218569 | A1 | 9/2010 | Hunt et al. | |
| 2012/0261928 | A1 | 10/2012 | Dye et al. | |
| 2015/0184426 | A1 * | 7/2015 | Arlinghaus et al. | E05B 65/1053 292/138 |

* cited by examiner

EXIT PUSH RAIL MONITORING SYSTEM WITH HALL EFFECT SENSOR

BACKGROUND OF THE INVENTION

1. Field of the Invention

This invention relates to door controls and in particular to doors employing push rails or pads which monitor attempts to egress through the door.

2. Description of Related Art

Delayed egress exit devices include a push rail or pad "request to exit" monitoring feature and are commonly used in schools, nursing homes, maternity wards, Alzheimer patient areas, psychiatric facilities, airports, shopping centers, libraries and other locations to provide a means of monitoring egress to prevent unauthorized exit through a door. When a delayed egress exit device is armed and the push rail or pad is depressed off of the normal home position, a monitoring feature within the device detects this movement and sounds a warning horn or alarm from the rail to alert personnel that someone is attempting egress. The sounding of the horn or alarm may be delayed to wait for the rail to remain depressed for a predetermined amount of time, e.g., 1-5 seconds, to avoid nuisance alarms. Depressing the rail or pad also triggers a "delay egress" condition which initiates a timer for a set period of time. The exit device may then stay secure and locked, preventing opening of the door and egress, for a desired amount of delay time, e.g., 15, seconds or more, thereby allowing time for personnel to respond to determine an appropriate response to the pending violation. After the set period of time expires, the push rail is released and functions as a standard exit device, allowing the door latch to unlock and open for free and immediate egress by the individual through the door. After this set period of time, the irreversible alarm state is then maintained until it is reset by authorized personnel. The exit device may be reset and re-armed automatically from the alarm condition after a predetermined period of time, e.g., 30-60 seconds, or may be reset manually, either at the door or by a remote control of the device.

Such delayed egress exit devices may be used to control most standard types of door locks and latches, such as rim, surface vertical rod, concealed vertical rod and mortise exit devices. They are typically self-contained within a rail assembly, external magnetic lock outputs available for extra high security. A standard size key-operated cylinder in the rail assembly or a remotely-connected device may be used by authorized personnel to disarm the device and provide momentary or maintained egress with key, e.g. 5-40 seconds or more, bypassing the alarm. The key may also be used by authorized personnel to reset the device. If connected to a fire or other remote alarm, the delayed egress device may also be disarmed to permit immediate egress if such alarm is triggered. Delayed egress exit devices on a bank of multiple doors may be connected for gang release of the delayed egress function when any door in the bank goes into alarm or the bank is otherwise remotely released.

A spring or other mechanism holds the push rail or pad of the delayed egress exit device in what is known as the extended or "home" position before and after it is depressed. If the push rail or pad of the device does not remain in or return to the proper home position when released, even if only by a minor distance, the product goes into "error mode" alerting the end user that the product is no longer operational. Failure of the rail or pad of the device to remain in or return to the proper home position may be caused by, mis-installation, tampering, blocking or worn-out components, and any other conditions that would influence the push rail or pad.

SUMMARY OF THE INVENTION

Bearing in mind the problems and deficiencies of the prior art, it is therefore an object of the present invention to provide a system and method for monitoring an exit push rail, and in particular, delayed egress exit device.

It is another object of the present invention to provide a delayed egress exit device which has enhanced reliability, and is less susceptible to errors due to problems in home positioning of the push rail or pad.

A further object of the invention is to provide a delayed egress exit device that remains in operation despite minor mis-positioning of the push pad or rail when released.

It is yet another object of the present invention to provide a delayed egress exit device that eliminates the need for frequent field adjustment, and automatically adjusts for changes in home position of the push pad or rail within predetermined limits.

It is also a further object of the invention is to provide a method and control system for a delayed egress exit device that continually monitors the home position of the push rail or pad.

Still other objects and advantages of the invention will in part be obvious and will in part be apparent from the specification.

The above and other objects, which will be apparent to those skilled in the art, are achieved in one aspect of the present invention which is directed to an exit push rail monitoring system comprising a housing mountable to a door, a push rail movable relative to the housing between a home position and a second position, and a sensor connected to one of the rail or housing. A control circuit is connected to the sensor to detect a current position of the push rail in the home position. The control circuit uses the current position of the push rail detected by the sensor to determine if the push rail is within a predetermined acceptable range of positions relative to the home position.

The sensor may be an analog Hall effect sensor connected to one of the rail or housing. The device may further include a magnet connected to the other of the rail or housing. The analog Hall effect sensor and the magnet may be mounted for relative motion between the rail and housing as the push rail moves between the home position and the second position. The control circuit may be connected to the analog Hall effect sensor to detect the current position of the push rail in the home position, and the control circuit may use the current position of the push rail detected by the analog Hall effect sensor to determine if the push rail is within the predetermined acceptable range of positions relative to the home position. The control circuit connected to the analog Hall effect sensor may detect a current position of the push rail as the push rail moves away from a previous home position.

The system may further include an alarm connected to the control circuitry, and the control circuitry may activate the alarm if the current position of the push rail is outside of a predetermined range. A timer may be connected to the control circuitry, and the control circuitry may determine if the push rail is within the predetermined acceptable range of positions relative to the home position at intervals set by the timer. The control circuitry detects the current position of the push rail at periodic intervals.

If the current position of the push rail is outside of a predetermined range, the control circuit may indicate an error in the exit push rail system and/or the control circuit may initiate one or more of the following: a) activate an alarm, b) unlock the door for immediate egress, c) relay an error message via light or sound and/or d) communicate the alarm or error status to a remote monitoring device. The control circuit may determine whether the push rail is in the second position, and the current position of the push rail may be detected at periodic intervals if the push rail is not determined to be in the second position.

In a further aspect, the present invention is directed to a method of monitoring an exit push rail system for a door comprising a push rail movable relative to a housing between a home position and a second position to open the door, and an analog Hall effect sensor magnet mounted for relative motion therebetween as the push rail moves between the home position and the second position. The method includes using the analog Hall effect sensor to detect a current position of the push rail in the home position and using the current position of the push rail detected by the analog Hall effect sensor to determine if the push rail is within a predetermined acceptable range of positions relative to the home position.

In another aspect, the present invention is directed to a method of monitoring a delayed egress exit push rail system for a door comprising a push rail movable relative to a housing between a home position and a second position to open the door, a sensor for determining the position of the push rail as the push rail moves between the home position and the second position and a controller connected to the sensor. The method comprises using the sensor to detect a current position of the push rail in the home position and using the controller to determine if the current position of the push rail detected by the sensor is within a predetermined acceptable range of positions relative to the home position. If the controller deter nines that the current position of the push rail is outside of the predetermined range, the controller indicates an error in the delayed egress exit push rail system and/or initiates one or more of the following: a) activating an alarm, b) unlocking the door for immediate egress, c) relaying an error message via light or sound and/or d) communicating the alarm or error status to a remote monitoring device. The method may further include using the controller to determine whether the push rail is in the second position to open the door, wherein the controller determines the current position of the push rail if the push rail is not deter mined to be in the second position.

The analog Hall effect sensor may be used to detect a current position of the push rail as the push rail moves away from a previous home position. The current position of the push rail may be detected at periodic intervals. The current position of the push rail may be detected by a control circuit in a controller. If the current position of the push rail is outside of a predetermined range, the controller may indicate an error in the exit push rail system and/or the controller may initiate one or more of the following: a) activating an alarm, b) unlocking the door for immediate egress, c) relaying an error message via light or sound and/or d) communicates the alarm or error status to a remote monitoring device.

The method may further include determining whether the push rail is in the second position to open the door, and the current position of the push rail may be detected at periodic intervals if the push rail is not determined to be in the second position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENTS(S)

In describing the embodiments of the present invention, reference will be made herein to FIGS. 1-8 of the drawings in which like numerals refer to like features of the invention.

The present invention modifies the prior art delayed egress exit device and provides a monitoring feature which measures the position of the push rail or pad. Unless otherwise noted, the term rail shall also refer to a pad or other mechanism which is pushed by an individual user to attempt to exit though the door which the delayed exit device controls. The monitoring feature in one embodiment of the invention utilizes a magnet, an analog Hall effect sensor, and a microprocessor with firmware controlling the operation thereof. The push rail is monitored in real-time measuring any position differential off of or from the "home position," which is the fully extended position. The magnet is disposed to move in conjunction with movement of the push rail. The analog Hall effect sensor is a transducer that varies its output voltage in response to application of the magnetic field of the magnet, and is maintained in a static position. Thus, any movement from the push rail is detected by the analog Hall effect sensor through the motion of the rail and magnet. The voltage output of the analog Hall effect sensor is detected by the processor. Any movement in the push rail provides a voltage differential. The processor may have firmware or software that can determine if push rail is in home position via the voltage measurement. Any movement from this position produces a voltage differential, and the firmware or software will evaluate if the movement reaches a predetermined value that will trigger the processor to initiate the alarm mode or if the push rail is not in the home position to initiate the error mode. During typical use, when a user depresses the rail, the rail and magnet move toward the analog Hall effect sensor, which sends a voltage differential to the processor initiating the product to go into the alarm mode. For the home position monitoring feature, at any desired time or at periodic intervals the sensor determines if the home position parameter, i.e., voltage output, is within a predetermined acceptable range through a self-adjusting calibration routine at the time of startup and is constantly calibrated throughout the service period. This method and system insures the proper operation of the device at all times.

Figure 1:
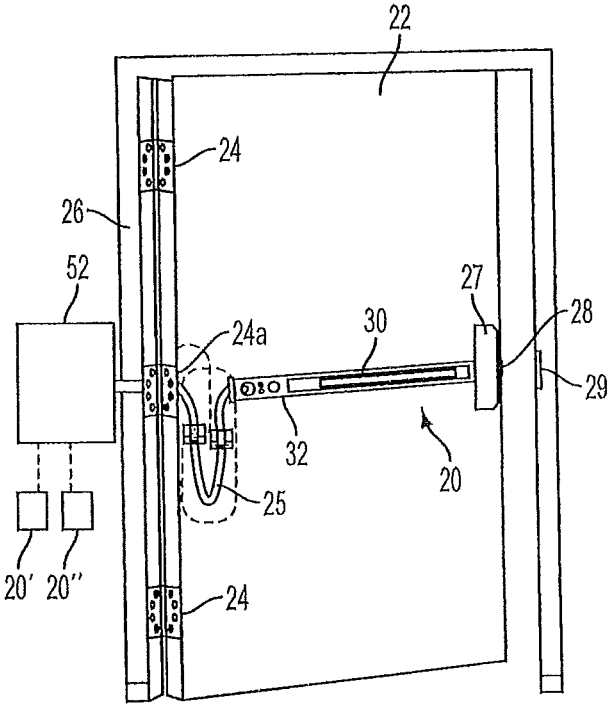
FIG. 1 is a perspective view of the inside of a partially-open door having installed thereon an embodiment of the delayed egress exit device of the present invention.

An example of a delayed egress exit device employing the system and method of the present invention is shown in FIGS. 1-5. The delayed egress exit device 20 is mounted horizontally on door 22 which swings between a closed position and an open position on hinges 24 mounted to one edge thereof and door jamb 26 (FIG. 1). Power and/or control connection 25 may be made to the delayed egress exit device via an electric hinge 24*a* from a master control system 52, which may monitor the status of and operate one or more other similarly-configured doors with delayed egress exit devices 20', 20" separately or in a gang. Latchbolt 28 in lock 27 on the opposite edge of the door is normally in the extended, locked position in door catch 29 to prevent the door from opening. Upon operation of the delayed egress exit device by pushing rail 30 toward the door, a horn or alarm 60 will sound, and after waiting for the delay period while still maintaining downward force on the rail, latchbolt 28 will move inward to the unlatched position so that the user may push open the door by continuing to apply force to the rail. After the user is outside and the door is shut, e.g., by a door closer, the latchbolt normally returns to the latched position automatically. Any type of door lock or latch may be controlled by the delayed egress device 20.

Figure 2:
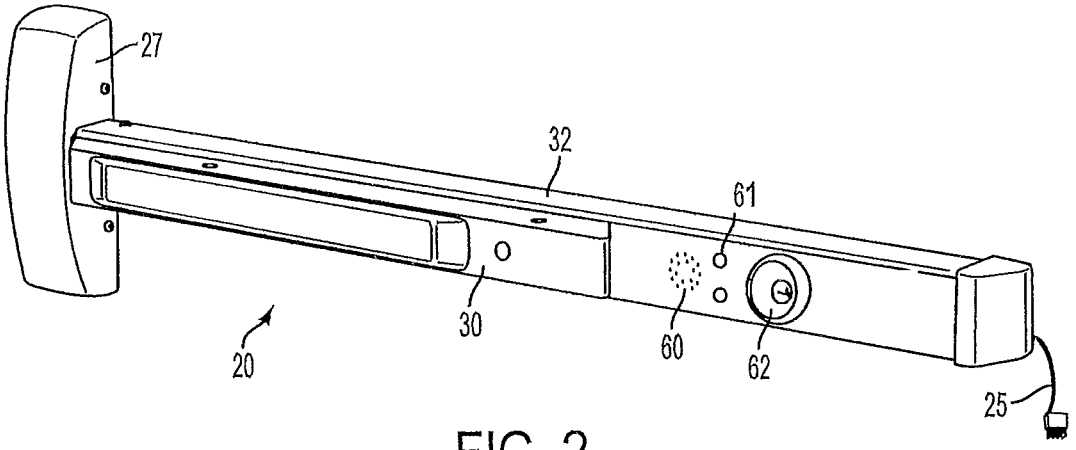
FIG. 2 is a front perspective view of the delayed egress exit device of FIG. 1.
Figure 3:
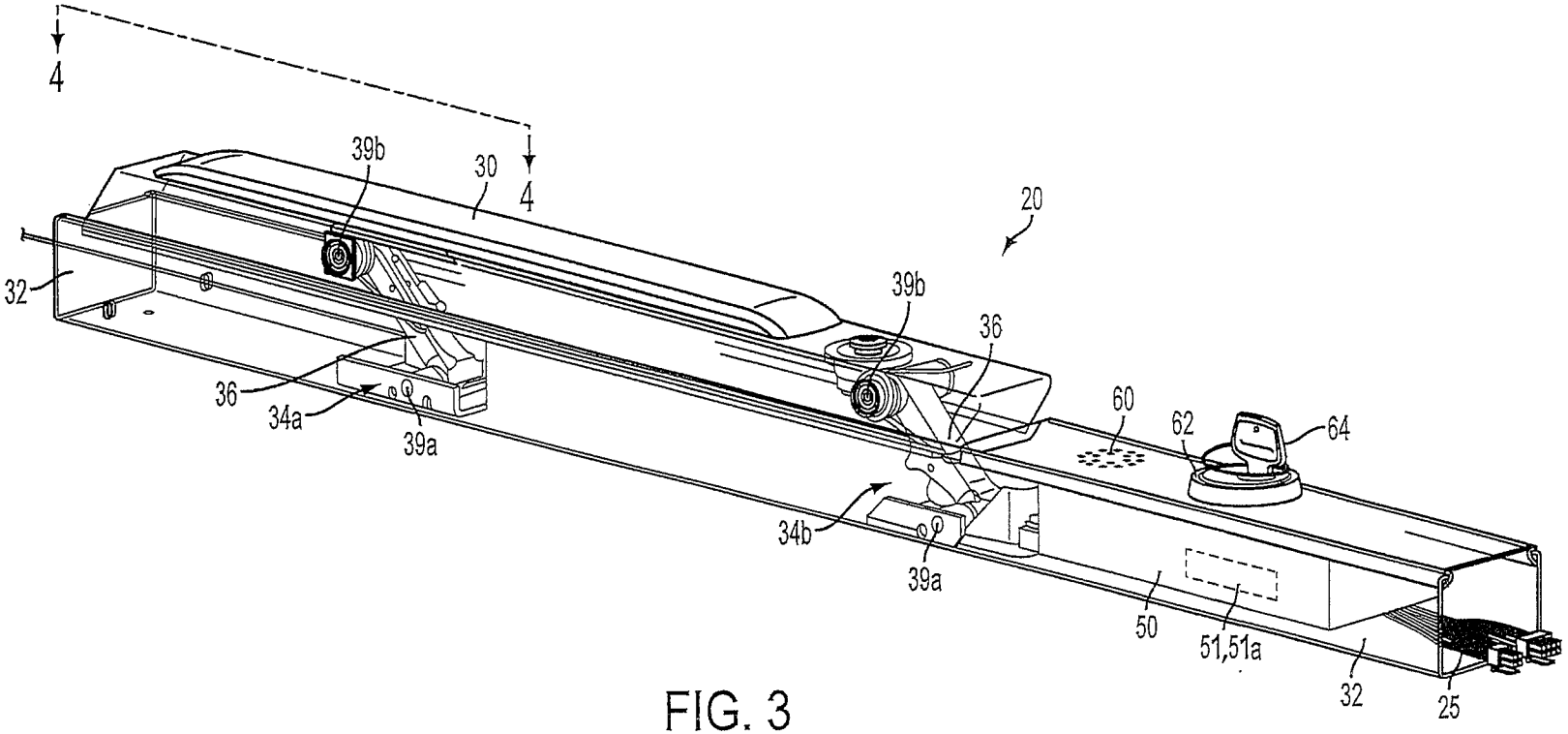
FIG. 3 is a top perspective view of the delayed egress exit device of FIG. 1 showing interior components.
Figure 4:
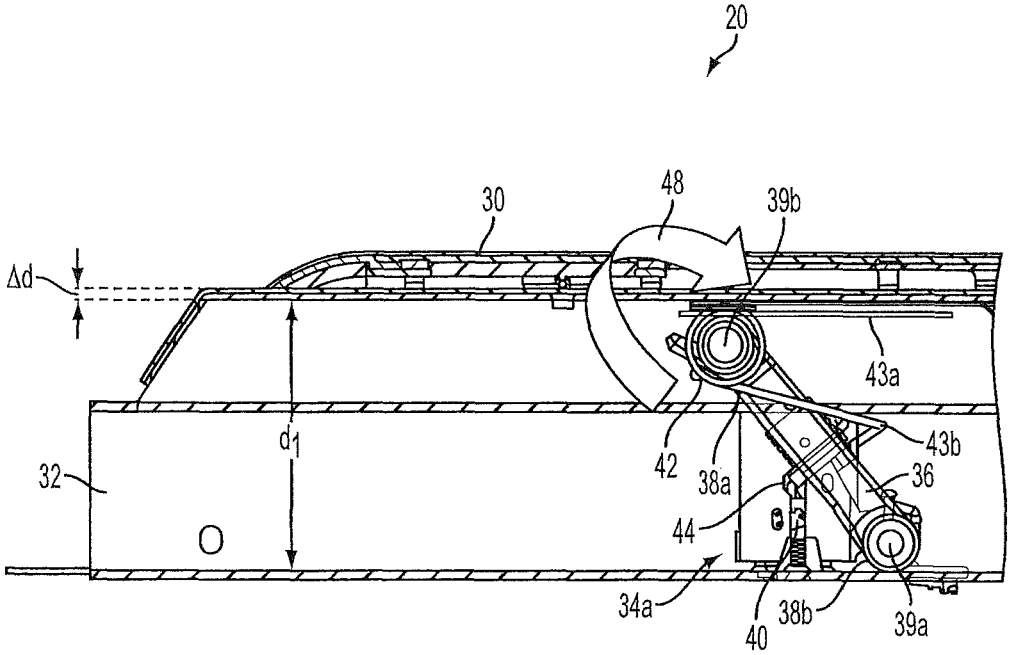
FIG. 4 is a cross-sectional view of a portion of the delayed egress exit device of FIG. 3 along line 4-4 with the push rail in the extended, home position.
Figure 5:
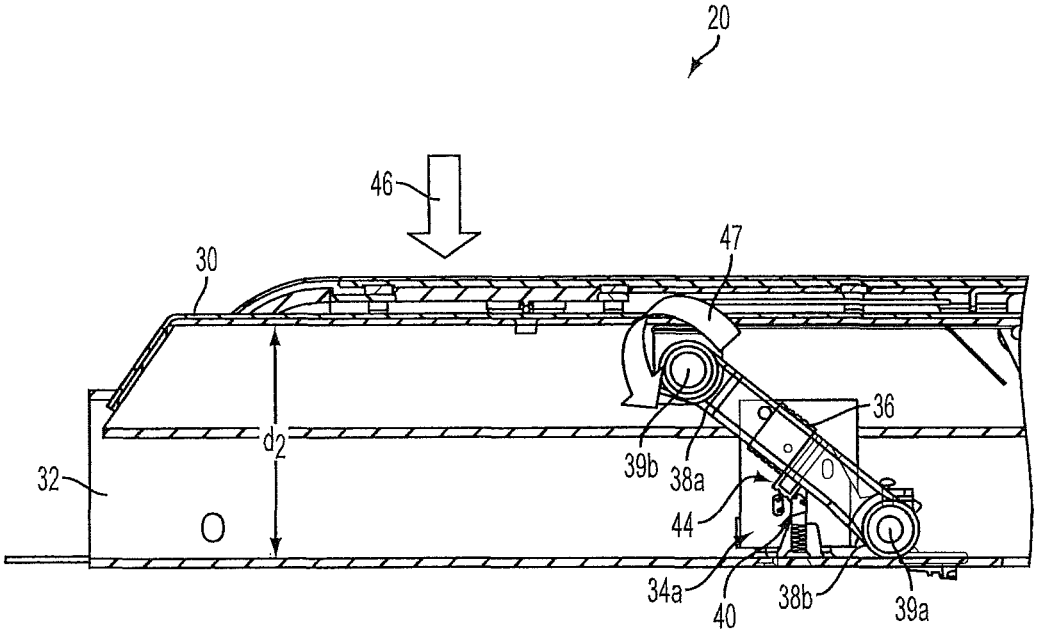
FIG. 5 is a cross-sectional view of a portion of the delayed egress exit device of FIG. 3 with the push rail in the depressed, second position.

More detailed views of the embodiment of the delayed egress exit device 20 is shown in FIGS. 2-4. Housing 32 is rectangular in configuration and contains a pair of bracket assemblies 34*a*, 34*b* which support elongated push rail 30 (FIG. 3). On each bracket assembly a connecting arm 36 is pivotally connected on one end 38*a* to a shaft 39*a* secured on the base of housing 32, and at the other end 38*b* to a shaft 39*b* secured on the inside of rail 30. Rail 30 is shown in the extended or home position in FIG. 4, with a distance $d_1$ between the rail interior surface and the housing 32 base. As rail 30 is pushed inward and depressed, as shown in FIG. 5, rail 30 moves closer to the housing base to a shorter distance $d_2$, which trips the sensor(s) to signal that someone is attempting egress, as explained further below. The simultaneous rotational pivoting of arms 36 also causes the rail to move slightly horizontally (left in FIGS. 3-5) as it is maintained in a position parallel to and within the housing. Each bracket assembly may have a coil-type return spring 42 that surrounds shaft 39*b* and has arms 43*a*, 43*b* that engage the inside of the rail 30 and the arm 36, respectively, to urge the connecting arm away from the rail, and thereby urge the rail away from the housing base to the rail extended or home position when an individual is not applying force to push the rail inward.

Analog Hall effect sensor 40 is provided and resides on a static portion of the housing, here shown on bracket assembly 34*a* (FIGS. 4 and 5). To detect when the rail has been pushed inward and trigger the system a magnet 44 is provided and resides on connecting arm 36, which moves in conjunction with the push rail, in the vicinity of the analog Hall effect sensor. Alternatively, magnet 44 may be secured to the non-moving housing and analog Hall effect sensor 40 may be secured to the movable connecting arm or rail. Regardless of which component is fixed and which is movable, relative motion between the analog Hall effect sensor and the magnet may be determined as the push rail moves between the home position extended away from the housing base and the second position closer to the housing base. Detection of the push rail movement and determination of the degree of movement is made by a control circuit connected to the analog Hall effect sensor and located in controller 50 within housing 32. A controller 50 contains control circuitry 51 and is connected to the analog Hall effect sensor 40, alarm 60 and cylinder 62. The control circuit 51 measures the voltage output of analog Hall effect sensor 40 as a result of relative movement with magnet 44, and once the voltage changes by a predetermined amount that indicates sufficient inward movement of rail 30 and connecting arm 36, a horn or alarm 60 in the housing is triggered by the control circuitry and a timer 51*a* in the control circuitry commences timing to determine when the lock latch is released to permit exit through the door. Key 64 may be used by authorized personnel to operate cylinder 60 to signal to controller 50 to bypass, disarm or reset delayed egress exit device 20. Controller 50 may also be connected to and operated remotely as part of a bank of similarly configured doors by a master controller 52 via connection 25 (FIG. 1).

The rail 30 in the home position may not be consistently located at a repeatable, precise distance $d_1$ because of mis-installation, tampering, blocking of the rail, worn-out springs or other components, or various other factors. This change in or mis-positioning of rail 30 at the home position is shown by the variation $\Delta d$ in FIG. 4. In prior art devices, the delayed egress device would go into error mode and disable operation if the push rail or pad did not remain in or return to the precise home position when released, even if only by a minor distance. To avoid such error mode disabling of the device, the present invention determines if the push rail is within a predetermined acceptable range of positions relative to the home position before entering into a disabling error mode. More specifically, the control circuit 51 in controller 50 uses the current position of the push rail detected by the analog Hall effect sensor 40 to determine if the push rail is within such predetermined acceptable range of positions and calibrate the error mode.

When the push rail is re-armed and in the fully extended home position, the analog Hall effect sensor 40 in conjunction with the magnet 44 outputs a voltage value ($V_{home}$). This $V_{home}$ voltage value is measured by the microcontroller 50 and is used as a relative value for determining the push rail position. This relative value is compared to the real-time measured value to determine that the push rail has moved off of the home position causing an alarm condition. Through experimental data, which may be determined without undue experimentation, there may be determined an acceptable voltage range established when the rail is in the "home position". If the $V_{home}$ home position voltage value is determined to be outside this predetermined range, an error condition will be deemed to have occurred. In accordance with the method of the present invention, a calibration routine may be run by the controller periodically, e.g., every 30 minutes, to measure the $V_{home}$ to ensure that it is with the predetermined voltage range. If it is in within such predetermined range, the $V_{home}$ value is used to calculate the push rail position. If it is out of such range, a calibration error is deemed to have occurred.

Figure 6:
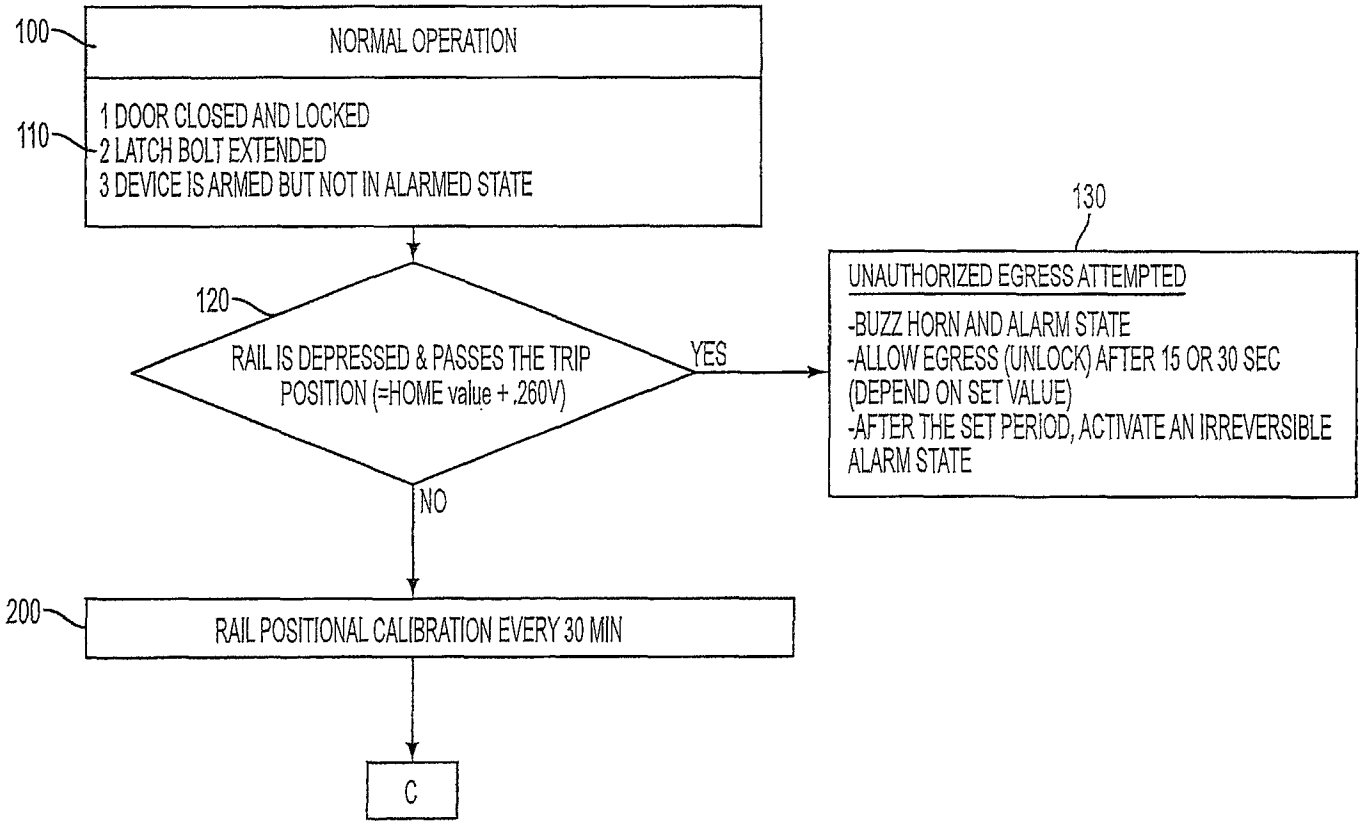
FIG. 6 is a flowchart illustration of the method of normal operation of the delayed egress exit device of the present invention.

Normal operation 100 of the delayed egress device of the present invention is shown in the flow diagram of FIG. 6. Such normal operation is determined by conditions 110 in which 1) the door is closed and locked, 2) the latchbolt is extended and 3) the delayed egress exit device is armed but not in an alarmed state. Controller 50 then waits and determines whether the push rail is depressed such that it passes the trip position (position $d_2$ in FIG. 5). This is indicated to the controller by measurement of the analog Hall effect sensor 40 voltage, which will be the home position voltage $V_{home}$ plus the change or increase in voltage due to closer movement of the magnet 44, e.g., +0.260V. If the measured analog Hall effect sensor voltage reaches a value that indicates that the rail has been sufficiently depressed to indicate that a user wishes to exit through the door 130, then the controller sounds the horn or alarm 60 and unlocks the door and allows egress after a predetermined set period of time, e.g., 15 or 30 seconds. After this set period of time, the irreversible alarm state is then maintained until it is reset by authorized personnel. If no rail push is indicated for a predetermined period of time, e.g., 30 minutes, the controller enters the rail positional calibration mode 200.

Figure 7:
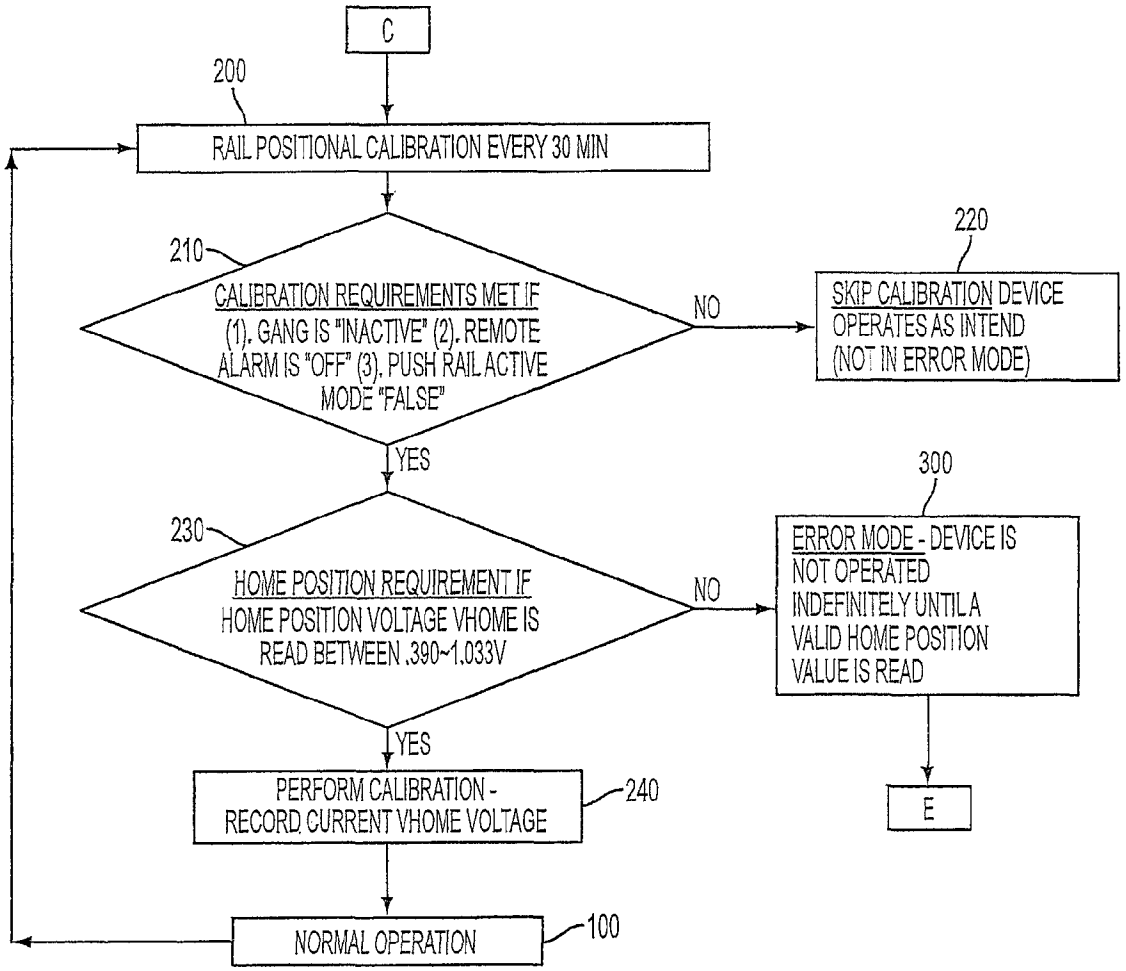
FIG. 7 is a flowchart illustration of the method of calibration of the push rail home position and voltage of the delayed egress exit device of the present invention.
Figure 8:
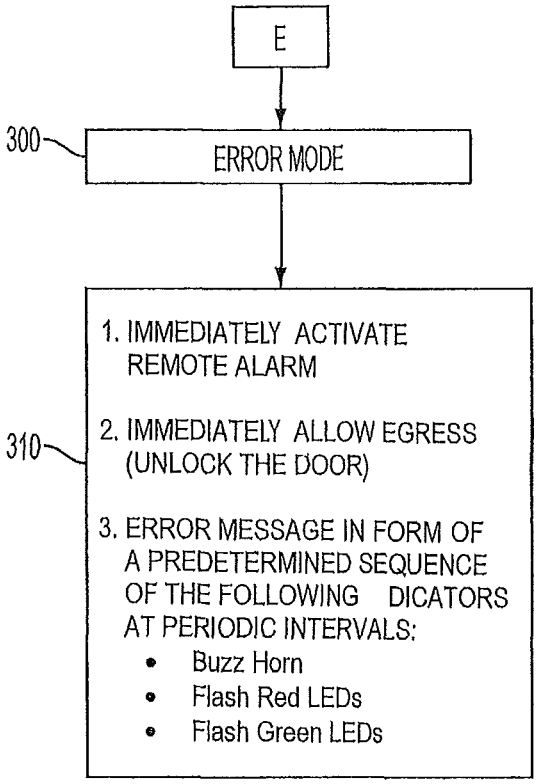
FIG. 8 is a flowchart illustration of the method of error mode of the delayed egress exit device of the present invention.

The rail positional calibration mode 200 is shown in more detail in the flow diagram of FIG. 7. The controller determines if the requirements for calibration are met 210. These requirements may include 1) any gang action is in the inactive state (i.e., no release of delayed egress triggered by other doors connected in a bank), 2) the system alarm is not active and 3) the push rail active mode is not triggered (i.e., the voltage from the analog Hall effect sensor does not indicate that the rail is depressed). If the calibration conditions are not met, calibration is skipped 220, and the device operates as intended, not in the error mode. If the calibration conditions are met, the controller determines whether the rail is within a predetermined permitted range of home location (Δd in FIG. 4) by measurement of the analog Hall effect sensor voltage associates with such permitted home positional deviation, e.g., between 0.390V and 1.033V. If the rail is determined to be outside of the permitted home voltage and position value range, error mode 300 is entered, and as shown in FIG. 8: 1) the remote alarm is immediately activated, 2) the door is unlocked for immediate egress and 3) error messages are relayed via lights or sound, as described in box 310 or as otherwise desired. The lights 61 may be located on the device as colored LEDs or other indicators, and the sound may be emitted from horn 60. Optionally, the alarm or error status may be communicated to a remote monitoring device, such as master control system 52, to alert authorized personnel. If the rail is determined to be within the permitted home voltage and position value range, calibration 240 is performed by reading and recording the current analog Hall effect sensor voltage $V_{home}$. The new current position voltage value $V_{home}$ is then used for further determination of the position of the rail from voltage readings of the relative position of the analog Hall effect sensor and magnet and to determine whether the rail has been depressed to activate delayed egress through the door.

An embodiment of the delayed egress exit device of the present invention and its control system may take the form of an entirely hardware embodiment, or an embodiment that uses software (including firmware, resident software, micro-code, etc.). Furthermore, an embodiment may take the form of a computer program product on a tangible computer-usable storage medium having computer-usable program code embodied in the medium. A memory device or memory portion of a processor 50 as shown in FIG. 3 can form the medium. Computer program code or firmware to carry out an embodiment of the present disclosure could also reside on optical or magnetic storage media, especially while being transported or stored prior to or incident to the loading of the computer program code or firmware into a door controller. This computer program code or firmware can be loaded by connecting a computer system or external controller to the programming interface of processor 50.

It should be appreciated and understood that the present invention may be embodied as systems, methods, apparatus, computer readable media, non-transitory computer readable media and/or computer program products. The present invention may take the form of an entirely hardware embodiment, an entirely software embodiment (including firmware, resident software, micro-code, etc.) or an embodiment combining software and hardware aspects that may all generally be referred to herein as a "circuit," "module" or "system." The present invention may take the form of a computer program product embodied in one or more computer readable medium(s) having computer readable program code embodied thereon.

One or more computer readable medium(s) may be utilized, alone or in combination. The computer readable medium may be a computer readable storage medium or a computer readable signal medium. A suitable computer readable storage medium may be, for example, but not limited to, an electronic, magnetic, optical, electromagnetic, infrared, or semiconductor system, apparatus, or device, or any suitable combination of the foregoing. Other examples of suitable computer readable storage medium would include, without limitation, the following: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CD-ROM), an optical storage device, a magnetic storage device, or any suitable combination of the foregoing. A suitable computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computing device (such as, a computer), partly on the user's computing device, as a stand-alone software package, partly on the user's computing device and partly on a remote computing device or entirely on the remote computing device or server. In the latter scenario, the remote computing device may be connected to the user's computing device through any type of network, including a local area network (LAN) or a wide area network (WAN), or the connection may be made to an external computing device (for example, through the Internet using an Internet Service Provider).

The present invention is described herein with reference to flowchart illustrations and/or block diagrams of methods, apparatus (systems), computer readable media, non-transitory computer readable media, and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computing device (such as, a computer), special purpose computing device, or other programmable data processing apparatus to produce a machine, such that the instructions, which execute via the processor of the computing device or other programmable data processing apparatus, create means for implementing the functions/acts specified in the flowchart and/or block diagram block or blocks.

These computer program instructions may also be stored in a computer readable medium that can direct a computing device, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computing device, other programmable data processing apparatus, or other devices to cause a series of operational steps to be performed on the computing device, other programmable apparatus or other devices to produce a computer implemented process such that the instructions which execute on the computing device or other programmable apparatus provide processes for implementing the functions/acts specified in the flowchart and/or block diagram block or blocks.

It should be appreciated that the function blocks or modules shown in the drawings illustrate the architecture, functionality, and operation of possible implementations of systems, methods and computer program media and/or products according to various embodiments of the present invention. In this regard, each block in the drawings may represent a module, segment, or portion of code, which comprises one or more executable instructions for implementing the specified logical function(s). It should also be noted that, in some alternative implementations, the functions noted in the block may occur out of the order noted in the figures. For example, the function of two blocks shown in succession may, in fact, be executed substantially concurrently, or the blocks may sometimes be executed in the reverse order, depending upon the functionality involved. It will also be noted that each block and combinations of blocks in any one of the drawings can be implemented by special purpose hardware-based systems that perform the specified functions or acts, or combinations of special purpose hardware and computer instructions. Also, although communication between function blocks or modules may be indicated in one direction on the drawings, such communication may also be in both directions.

The delayed egress exit device of the present invention is therefore able to periodically and continually calibrate the home position of the push rail or pad to capture new position values due to effects of mechanical and/or electrical parts variation, or due to environmentally caused variations. Thus, the invention achieves one or more of the objects above and provides for continual detection of malfunction of the devices, either if the device is hacked or if mechanical blocking is occurred, and even if the rail home position is shifted in every calibration cycle. The benefits of the delayed egress exit device of the present invention include elimination of frequent field adjustment to the prior art rail monitoring system during and after installation. The invention enhances product reliability based on accurate trip position monitoring and a continually calibrated home position. Switching reliability is enhanced with no switch moving parts, and security is enhanced with the error mode initiating the alarm signal. The invention further provides for self-adjusting and testing during manufacturing.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An exit push rail monitoring system comprising:

a housing mountable to a door;

a push rail movable relative to the housing between a home position having a predetermined acceptable range of positions relative thereto and a second position;

a sensor connected to one of the rail or housing;

a control circuit connected to the sensor to detect a current position of the push rail in relation to the home position, the control circuit using the current position of the push rail detected by the sensor to determine if the push rail is within the predetermined acceptable range of positions relative to the home position; and a timer connected to the control circuit, the control circuit determining if the push rail is within the predetermined acceptable range of positions relative to the home position at intervals set by the timer.

2. The system of claim 1 wherein the monitoring system is for a delayed egress exit device and the sensor is an analog Hall effect sensor connected to one of the rail or housing, and further including a magnet connected to the other of the rail or housing, the analog Hall effect sensor and the magnet being mounted for relative motion therebetween as the push rail moves between the home position and the second position; and wherein the control circuit is connected to the analog Hall effect sensor to detect the current position of the push rail in relation to the home position, the control circuit using the current position of the push rail detected by the analog Hall effect sensor to determine if the push rail is within the predetermined acceptable range of positions relative to the home position.

3. The system of claim 2 wherein the control circuit connected to the analog Hall effect sensor detects a current position of the push rail as the push rail moves away from the home position.

4. The system of claim 3 further including an alarm connected to the control circuit, the control circuit activating the alarm if the current position of the push rail is outside of a predetermined range.

5. The system of claim 1 further including an alarm connected to the control circuit, the control circuit activating the alarm if the current position of the push rail is outside of a predetermined range.

6. The system of claim 1 wherein the control circuit detects the current position of the push rail at periodic intervals.

7. The system of claim 1 wherein the control circuit connected to the sensor detects a current position of the push rail as the push rail moves toward the home position, and wherein if the current position of the push rail is outside of the predetermined acceptable range of positions when the push rail has concluded moving, the control circuit initiates an error mode in the exit push rail system.

8. The system of claim 1 wherein if the current position of the push rail is outside of a predetermined range, the control circuit initiates one or more of the following: a) activating an alarm via light and/or sound, b) unlocking the door for immediate egress, and/or c) communicating an error message to a remote monitoring device.

9. The system of claim 1 wherein the control circuit determines whether the push rail is in the second position, and wherein the current position of the push rail is detected at periodic intervals if the push rail is not determined to be in the second position.

10. A method of monitoring an exit push rail system for a door comprising a push rail movable relative to a housing between a home position having a predetermined acceptable range of positions relative thereto and a second position to open the door, and an analog Hall effect sensor magnet mounted on one of the push rail or the housing for sensing relative motion therebetween as the push rail moves between the home position and the second position, the method comprising:

using the analog Hall effect sensor magnet to detect a current position of the push rail in relation to the home position at intervals set by a timer; and using the current position of the push rail detected by the analog Hall effect sensor magnet to determine if the push rail is within the predetermined acceptable range of positions relative to the home position at each interval.

11. The method of claim 10 wherein the analog Hall effect sensor magnet is used to detect a current position of the push rail as the push rail moves away from the home position.

12. The method of claim 10 wherein the current position of the push rail is detected at periodic intervals.

13. The method of claim 10 wherein the current position of the push rail is detected by a control circuit in a controller.

14. The method of claim 13 wherein the analog Hall effect sensor magnet is used to detect a current position of the push rail as the push rail moves toward the home position, and wherein if the current position of the push rail is outside of the predetermined acceptable range of positions when the push rail has concluded moving, the controller initiates an error mode in the exit push rail system.

15. The method of claim 14 wherein if the current position of the push rail is outside of a predetermined range, the controller initiates one or more of the following: a) activating an alarm via light and/or sound, b) unlocking the door for immediate egress, and/or c) communicating an error message to a remote monitoring device.

16. The method of claim 10 further including determining whether the push rail is in the second position to open the door, and wherein the current position of the push rail is detected at periodic intervals if the push rail is not determined to be in the second position.

17. A method of monitoring a delayed egress exit push rail system for a door comprising a push rail movable relative to a housing between a home position and a second position to open the door, a sensor for determining the position of the push rail as the push rail moves between the home position and the second position, and a controller connected to the sensor, the method comprising:

using the sensor to detect a current position of the push rail in relation to the home position at intervals set by a timer connected to the controller; and using the controller to determine if the current position of the push rail detected by the sensor is within a predetermined acceptable range of positions relative to the home position at each interval.

18. The method of claim 17 wherein the sensor is used to detect a current position of the push rail as the push rail moves toward the home position, and wherein if the controller determines that the current position of the push rail is outside of the predetermined acceptable range of positions when the push rail has concluded moving, the controller initiates an error mode in the delayed egress exit push rail system.

19. The method of claim 17 wherein if the current position of the push rail is outside of a predetermined range, the controller initiates one or more of the following: a) activating an alarm via light and/or sound, b) unlocking the door for immediate egress, and/or c) communicating an error message to a remote monitoring device.

20. The method of claim 17 further including using the controller to determine whether the push rail is in the second position to open the door, and wherein the controller determines the current position of the push rail if the push rail is not determined to be in the second position.

* * * * *